US005179319A

United States Patent [19]

Iwasaki et al.

[11] Patent Number: 5,179,319

[45] Date of Patent: Jan. 12, 1993

[54] DEFLECTION YOKE FOR A COLOR CRT

[75] Inventors: Katsuyo Iwasaki, Nishinomiya; Osamu Konosu, Nagaokakyo; Akio Senju, Tamana, all of Japan

[73] Assignees: Matsushita Electronics Corporation; Matsushita Electric Industrial Co., Ltd., both of Osaka, Japan

[21] Appl. No.: 835,044

[22] Filed: Feb. 11, 1992

Related U.S. Application Data

[63] Continuation of Ser. No. 558,723, Jul. 27, 1990, abandoned.

[30] Foreign Application Priority Data

Jul. 31, 1989 [JP] Japan ..... 1-199007

[51] Int. Cl.[5] ..... H01J 29/70

[52] U.S. Cl. ..... 313/440; 313/431; 335/211

[58] Field of Search ..... 313/440, 431, 427, 428; 335/211, 214

[56] References Cited

U.S. PATENT DOCUMENTS 4,642,527 2/1987 Takahashi et al. ..... 313/431
4,728,915 3/1988 Konosu et al. ..... 335/211
4,788,470 11/1988 Kohzuki et al. ..... 313/440
4,896,071 1/1990 Pons ..... 313/440

FOREIGN PATENT DOCUMENTS 0218961 4/1987 European Pat. Off. .
62-217546 9/1987 Japan .
62-237648 10/1987 Japan .
1467475 3/1977 United Kingdom .
1528600 10/1978 United Kingdom .
1554235 10/1979 United Kingdom .
2140200A 5/1984 United Kingdom .

*Primary Examiner*—Donald J. Yusko
*Assistant Examiner*—N. D. Patel
*Attorney, Agent, or Firm*—Panitch, Schwarze, Jacobs & Nadel

[57] ABSTRACT

A conventional pair of magnetic members which conduct a leakage magnetic field from a vertical deflection coil, and which generate an auxiliary magnetic field for correction in a pincushion on the side of an electronic gun of the vertical deflection magnetic field are wound with auxiliary coils, and these auxiliary coils are connected to the vertical deflection coil. In addition to a conventional function of generating an auxiliary magnetic field, the auxiliary coils operate as a function of generating a magnetic field, so that a convergence distortion and spot distortion can be completely corrected without causing any damage.

2 Claims, 2 Drawing Sheets

DEFLECTION YOKE FOR A COLOR CRT

BACKGROUND OF THE INVENTION

1. Field of the Invention

This invention relates to a deflection yoke, mainly disposed in a color CRT comprising an in-line type electronic gun, in which a horizontal deflection magnetic field distorted in a pincushion and a vertical deflection magnetic field distorted in a barrel are generated.

2. Description of the Prior Art

In general, a deflection yoke disposed in a color CRT containing an in-line type electron gun comprises a horizontal deflection coil of the saddle type, and a vertical deflection coil of the toroidal type or saddle type. The horizontal deflection coil and the vertical deflection coil generate a horizontal deflection magnetic field distorted in a pincushion and a vertical deflection magnetic field distorted in a barrel, respectively. Therefore, the deflection yoke may have construction in which a dynamic convergence circuit is not required, that is, construction of a self-convergence. On the other hand, this kind of distorted magnetic field may become a cause for generating coma distortion. As shown in FIG. 3, in a picture with a convergence distortion, a green raster G due to an electron beam of the center and red and blue rasters R and B due to an electron beam of both sides are vertically shifted with each other. Also, as shown in FIG. 4, a rotational distortion (a spot distortion) can readily occur in red and blue beam spots which are formed from the electron beam of both sides at the periphery of the picture, and the generation of such a spot distortion makes it difficult to obtain high resolution tube performance.

As a solution to the above-mentioned problems, in the invention disclosed in the Japanese Laid-Open Patent Publication No. 62-217546, an electron gun section of a vertical deflection magnetic field is distorted in a pincushion. That is, first and second magnetic members pick up a leakage magnetic flux from a vertical deflection coil of the toroidal type, and a function of generating the magnetic field performed by both magnetic members generates an auxiliary magnetic field for correction in a pincushion distribution at the end portion of the electron gun.

The solution to coma distortion by the use of the above-mentioned construction is very effective. However, it is difficult to satisfactorily obtain a required auxiliary magnetic field in a pincushion distribution only by the first and second magnetic members. Actually, it is necessary to adjust the distribution of a coil winding of the vertical deflection coil itself. Moreover, when the distribution of the coil winding of the vertical deflection coil itself is adjusted as a part of the solution to the coma distortion, the adjustment capacity of the distribution of the coil winding for convergence correction is lowered.

SUMMARY OF THE INVENTION

The deflection yoke for a color CRT of this invention, which overcomes the above-discussed and numerous other disadvantages and deficiencies of the prior art, comprises a horizontal deflection coil which generates a horizontal deflection magnetic field distorted in a pincushion, a vertical deflection coil which generates a vertical deflection magnetic field distorted in a barrel, an insulation frame supporting both deflection coils and having a cylindrical portion on the side of an electronic gun, first and second magnetic material chips which generate an auxiliary vertical deflection electric field distorted in a pincushion, electrically connected to the electronic gun portion of said vertical deflection magnetic field, and auxiliary coils, wherein said first and second magnetic material chips have main portions which oppose each other via a vertical axis, respectively, two branch portions elongating in parallel from the upper part and lower part of said main portions, and projecting toward said electronic gun along the outside surface of said cylindrical portion, and said auxiliary coils wind round said first and second magnetic material chips and are connected to said vertical deflection coil.

In a preferred embodiment, the auxiliary coils are wound round each main surface portion of said first and second magnetic material chips.

In another preferred embodiment, the auxiliary coils are wound round each branch portion of said first and second magnetic material chips.

Thus, the invention described herein makes possible the objective of providing a deflection yoke capable of correcting a convergence frame distortion and a spot frame distortion by presetting the appropriate number of windings of the auxiliary coils; that is, without adjusting the distribution of the coil winding of the vertical deflection coil itself, thereby giving a sufficient capacity for adjusting the distribution of the coil winding for convergence correction with respect to the vertical deflection coil itself.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
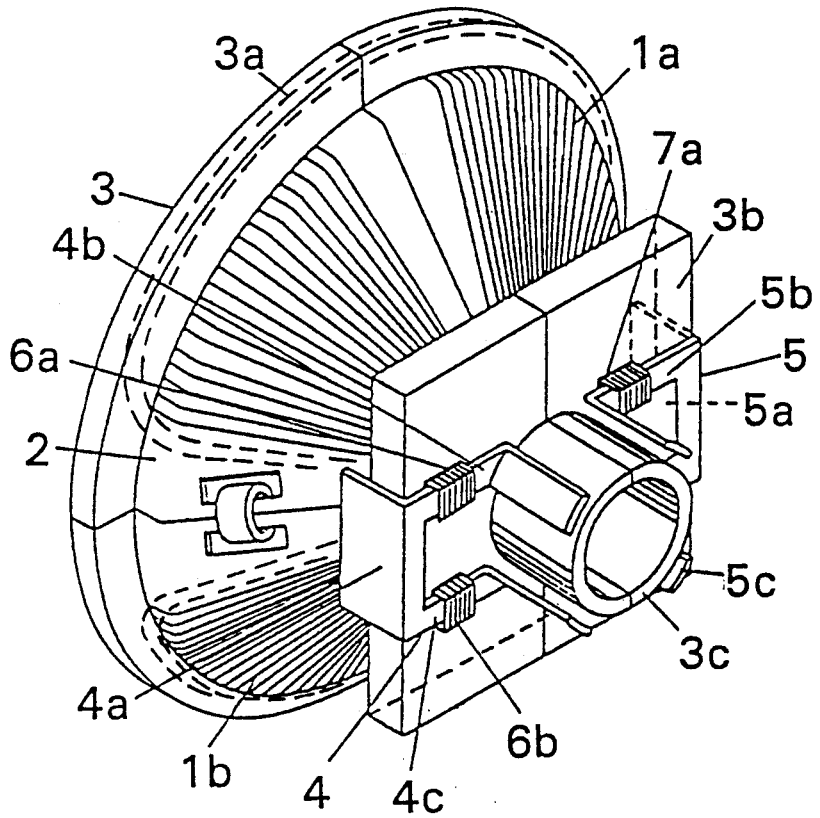
FIG. 1 is a perspective view showing a deflection yoke according to this invention.

Hereinafter, this invention will be described by way of example shown in the drawings.

As shown in FIG. 1, a pair of vertical deflection coils of the toroidal type 1*a* and 1*b* are supported by a ferrite core 2 with an insulation frame 3 and a pair of horizontal deflection coils of the saddle type (not shown). At a large rim 3*a*, the insulation frame 3 covers a circular portion on the side of the large rim of the horizontal deflection coil, and also, on the side of a small rim, the insulation frame 3 comprises a box portion 3*b* for accommodating a circular portion on the side of the small rim of the horizontal deflection coil and a cylindrical portion 3*c* projecting toward an electronic gun from the box portion 3*b*. On the outside surface of both walls of the box portion 3*b*, respective main surface portions 4*a* and 5*a* of first and second magnetic members 4 and 5 are disposed so that they may be magnetically coupled to the electron gun portion of the vertical deflection magnetic field, by being opposed to each other. Four branch portions 4*b*, 4*c*, 5*b*, and 5*c* which are bent toward a tube axis from the main surface portions 4*a* and 5*a*, elongate in parallel from the upper part and lower part, and project toward the electron gun along the outside surface of the cylindrical portion 3*c* are wound with auxiliary coils 6*a*, 6*b*, 7*a*, and 7*b*, respectively. The auxiliary coils 6*a*, 6*b*, 7*a*, and 7*b* are connected to each other in series or in parallel, and connected in series to the vertical deflection coils 1*a* and 1*b*.

Figure 2:
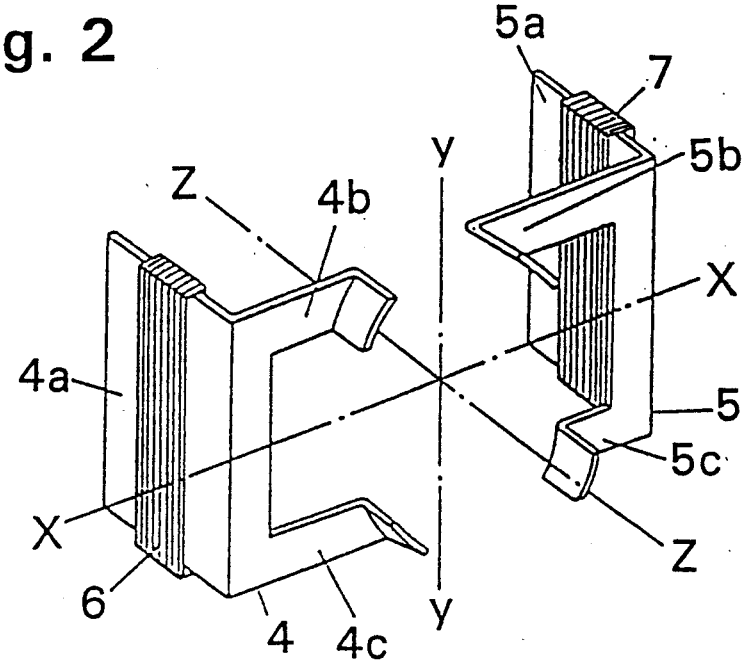
FIG. 2 is a perspective view showing main portions of another example of this invention.
Figure 3:
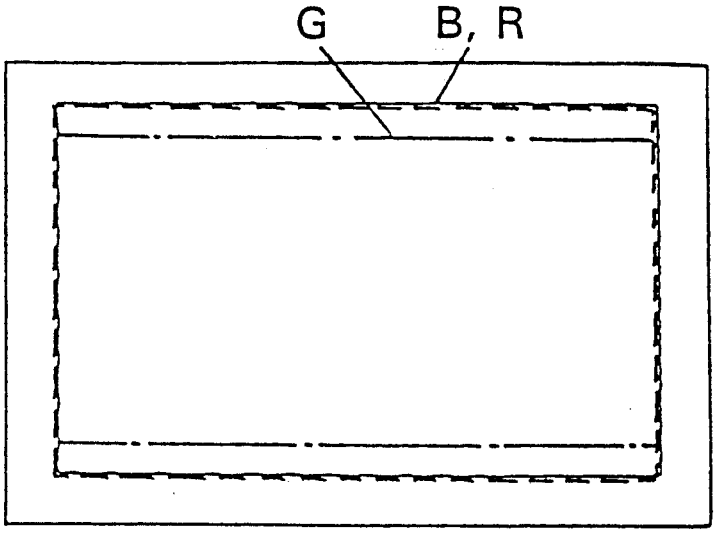
FIG. 3 is a view showing a pattern in which a convergence distortion is generated in a picture.
Figure 4:
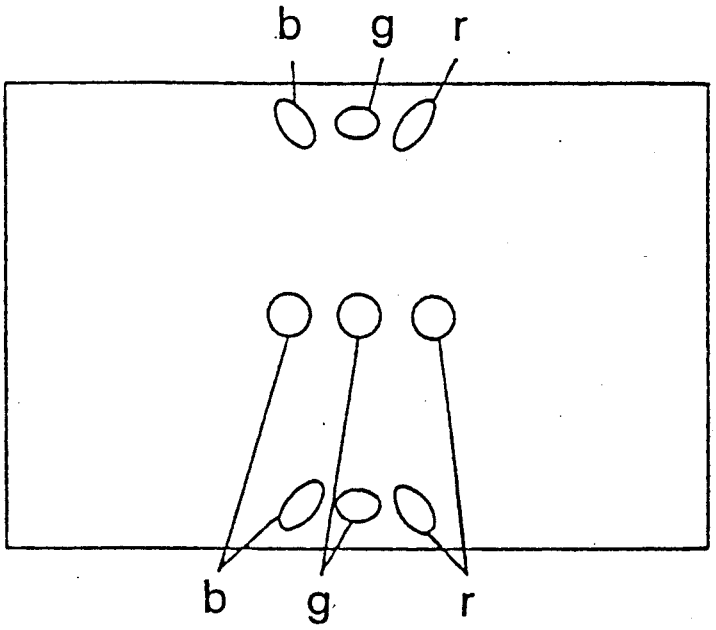
FIG. 4 is a view illustrating a spot distortion.

In the above-mentioned example, the auxiliary coils wind round two pairs of branch portions. As shown in FIG. 2, auxiliary coils 6 and 7 may wind round the main surface portions 4*a* and 5*a*, and the auxiliary coils 6 and 7 may be connected in series to the vertical deflection coil.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof those skilled in the art to which this invention pertains.

What is claimed is:

1. A deflection yoke for a color cathode ray tube equipped with an in-line type electron gun, the deflection yoke comprising a horizontal deflection coil for generating a horizontal deflection magnetic field distorted in a pincushion, and a vertical deflection coil for generating a vertical deflection magnetic field distorted in a barrel, an insulation frame supporting said horizontal deflection coil and said vertical deflection coil and having a cylindrical portion projecting towards said electron gun, first and second magnetic members magnetically connected to said vertical deflection magnetic field toward said electron gun so as to generate an auxiliary vertical deflection magnetic field distorted in a pincushion and auxiliary coils, each of said first and second magnetic members having main portions mutually located at opposite positions to a common vertical axis, and two branch portions elongating in parallel from an upper part and a lower part of said main portions and projecting toward said electron gun along the outside surface of said cylindrical portion, wherein said auxiliary coils are wound around said main surface portions of said first and second magnetic members and connected to said vertical deflection coil so as to adjust the vertical deflection magnetic field by adjusting the distribution of the auxiliary coils for convergence correction.

2. A deflection yoke for a color cathode ray tube equipped with an in-line type electron gun, the deflection yoke comprising a horizontal deflection coil for generating a horizontal deflection magnetic field distorted in a pincushion, and vertical deflection coil for generating a vertical deflection magnetic field distorted in a barrel, an insulation frame supporting said horizontal deflection coil and said vertical deflection coil and having a cylindrical portion projecting towards said electron gun, first and second magnetic members magnetically connected to said vertical deflection magnetic field towards said electron gun so as to generate an auxiliary vertical deflection magnetic field distorted in a pincushion and auxiliary coils, each of said first and second magnetic members having main portions mutually located at opposite positions to a common vertical axis, and two branch portions elongating in parallel from an upper part and a lower part of said main portions and projecting toward said electron gun along the outside surface of said cylindrical portion, wherein said auxiliary coils are wound around said branch portions of said first and second magnetic members and connected to said vertical deflection coil so as to adjust the vertical deflection magnetic field by adjusting the distribution of the auxiliary coils for convergence correction.

* * * * *